United States Patent [19]

Wilson et al.

[11] 4,241,965

[45] Dec. 30, 1980

[54] ELECTRICAL CONNECTOR FOR POWER PANEL SYSTEM

[75] Inventors: Harold R. Wilson, Holland Township, Ottawa County; Ditmar K. Tillmann, Holland, both of Mich.

[73] Assignee: Haworth Mfg., Inc., Holland, Mich.

[21] Appl. No.: 64,956

[22] Filed: Aug. 8, 1979

[51] Int. Cl.[3] ..... H01R 35/00

[52] U.S. Cl. ..... 339/4; 339/22 R

[58] Field of Search ..... 339/2 R, 2 A, 4, 6 R, 339/6 A, 8 R, 9, 21 R, 22 R, 22 B, 23, 24

[56] References Cited

U.S. PATENT DOCUMENTS

| | | | |
|---|---|---|---|
| 2,305,100 | 12/1942 | O'Brien | 339/23 |
| 4,043,626 | 8/1977 | Propst et al. | 339/23 |
| 4,060,294 | 11/1977 | Haworth et al. | 339/4 |
| 4,199,206 | 4/1980 | Haworth et al. | 339/4 |

*Primary Examiner*—Neil Abrams

*Attorney, Agent, or Firm*—Blanchard, Flynn, Thiel, Boutell & Tanis

[57] ABSTRACT

A hinged electrical connector for connecting the electrical terminals of adjacent wall panels. The connector is provided with two relatively rigid housing parts which, adjacent their outer ends, are provided with a plug-like connector portion adapted for releasable engagement with a similar connector portion associated with the electrical terminal on the wall panel. The adjacent inner ends of the housing parts each have an integral tubular hinge portion, which hinge portions angularly slidably interfit in telescopic relationship displaced about a hinge axis which is spaced outwardly from the physical structure defining the connector.

10 Claims, 10 Drawing Figures

ELECTRICAL CONNECTOR FOR POWER PANEL SYSTEM

FIELD OF THE INVENTION

This invention relates to a flexible electrical connector used in association with a wall system formed from a plurality of series-connected electrically-prewired panels and, more specifically, to an improved hinged electrical connector adapted to be releasably joined to electrical terminals on adjscent wall panels.

BAKCGROUND OF THE INVENTION

U.S. Pat. No. 4,060,294 and co-pending application Ser. No. 918 278, filed June 1, 1979, both owned by the assignee of this application, disclose interior wall systems of the type used for dividing offices and other interior regions into smaller work areas. These systems include a plurality of prefabricated upright panels releasably joined together and individually electrically prewired, with the electrical terminals on adjacent panels being joined by releasable flexible electrical connectors which plug into the adjacent terminals, whereby the supplying of electrical energy to areas bounded by the wall system is greatly facilitated. While these known wall systems are highly desirable and have met with substantial commercial success, nevertheless continued development has been carried out in an attempt to improve upon the usability and flexibility of such systems, specifically including the improvement of the system components including the flexible electrical connector used for electrically connecting adjacent panels.

Accordingly, the present invention relates to an improved flexible electrical connector of the type designed for releasably but electrically connecting the power terminals of adjacent wall panels as associated with a wall system of the aforesaid type. More specifically, this invention provides an improved flexible electrical connector possessing an improved hinge structure to facilitate the relative angular displacement between the two plug-in end portions of the connector, which hinge structure is designed so as to be disposed substantially entirely within the width of the wall panels so as to be more effectively hidden from view when assembled on the wall panels, thereby providing the wall system with a more streamlined and aesthetically pleasing appearance, specifically by avoiding the use of hinge parts which project or protrude outwardly from the side planes of the panels.

In the improved flexible connector of the present invention, as aforesaid, same is also provided with an improved hinge structure which, in addition to being positionable wholly between the side planes of the panel, also defines a hinge axis which is displaced radially from the actual hinge structure, with this hinge axis being spaced outwardly adjacent the side planes of the adjacent panels so that the hinge axis is effectively aligned with the hinge which structurally connects the adjacent panels, without the flexible connector protruding outwardly in an unsightly or less-than-pleasing appearance.

According to the present invention, there is also provided an improved flexible electrical connector designed specifically for use with the improved electrically-prewired wall system disclosed in co-pending application Ser. No. 44,514, filed June 1, 1979.

SUMMARY OF THE INVENTION

In the improved flexible electrical connector of this invention, same is provided with two relatively rigid housing parts which, adjacent their outer ends, are each provided with a pluglike connector portion adapted for releasable engagement with a similar connector portion associated with an electrical terminal mounted on a wall panel. The adjacent inner ends of the housing parts each have an integral hinge portion, which hinge portions angularly slidably interfit in telescopic relationship with one another and permit the two housing parts to be swingably displaced about a hinge axis which is spaced outwardly from the physical structure defining the hinge portions. The two housing parts, including the hinge portions integrally formed on the inner ends thereof, comprise elongated hollow tubular members so that a passage extends throughout the length of the flexible connector, which passage accommodates therein several elongated electrical conductors or cables which extend between the pluglike connectors for permitting transmission of electrical energy therebetween. The physical structure defining the cooperative hinge portions, by being spaced inwardly from the actual hinge axis, enables the hinge structure to be disposed within and substantially totally hidden between the side surfaces of the adjacent joined panels, with the hinge axis itself being effectively vertically aligned with the hinge structure which physically joins the adjacent panels.

In addition to the flexible connector as described above, this invention also relates to an improved wall system wherein each panel has a pair of electrically connected power blocks disposed adjacent the opposite corners thereof, with the opposed power blocks of adjacent panels being electrically joined together by the aforesaid hinged electrical connector, the latter cooperating with each of the electrical power blocks to form a plug-in connection therewith.

Figure 1:
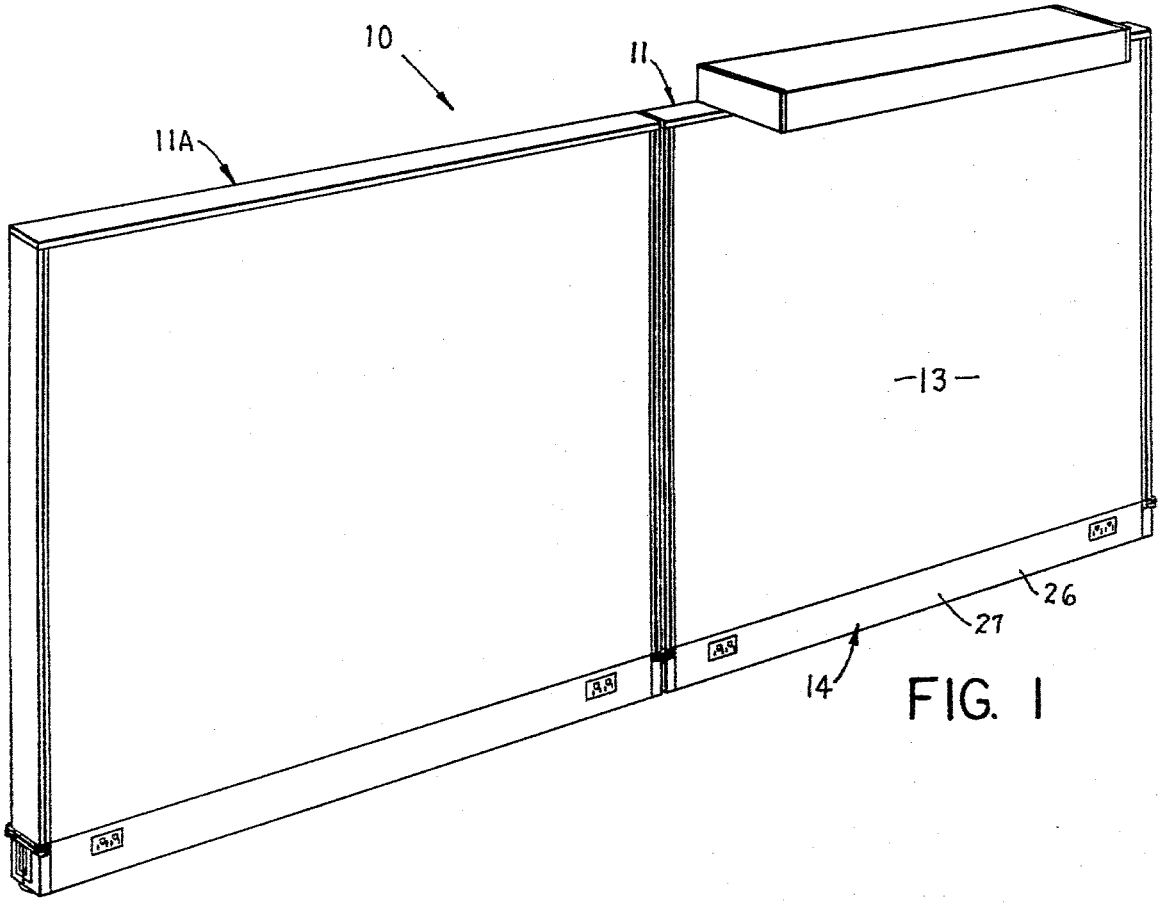
FIG. 1 is a perspective view illustrating a wall system incorporating therein the connector of the present invention, only two panels being horizontally series-connected for purposes of illustration.

Certain terminology will be used in the following description for convenience in reference only and will not be limiting. For example, the words "upwardly", "downwardly", "leftwardly" and "rightwardly" will refer to directions in the drawings to which reference is made. The words "inwardly" and "outwardly" will refer to directions toward and away from, respectively, the geometric center of the panel and designated components. Said terminology will include the words specifically mentioned, derivatives thereof, and words of similar import.

DETAILED DESCRIPTION

Figure 8:
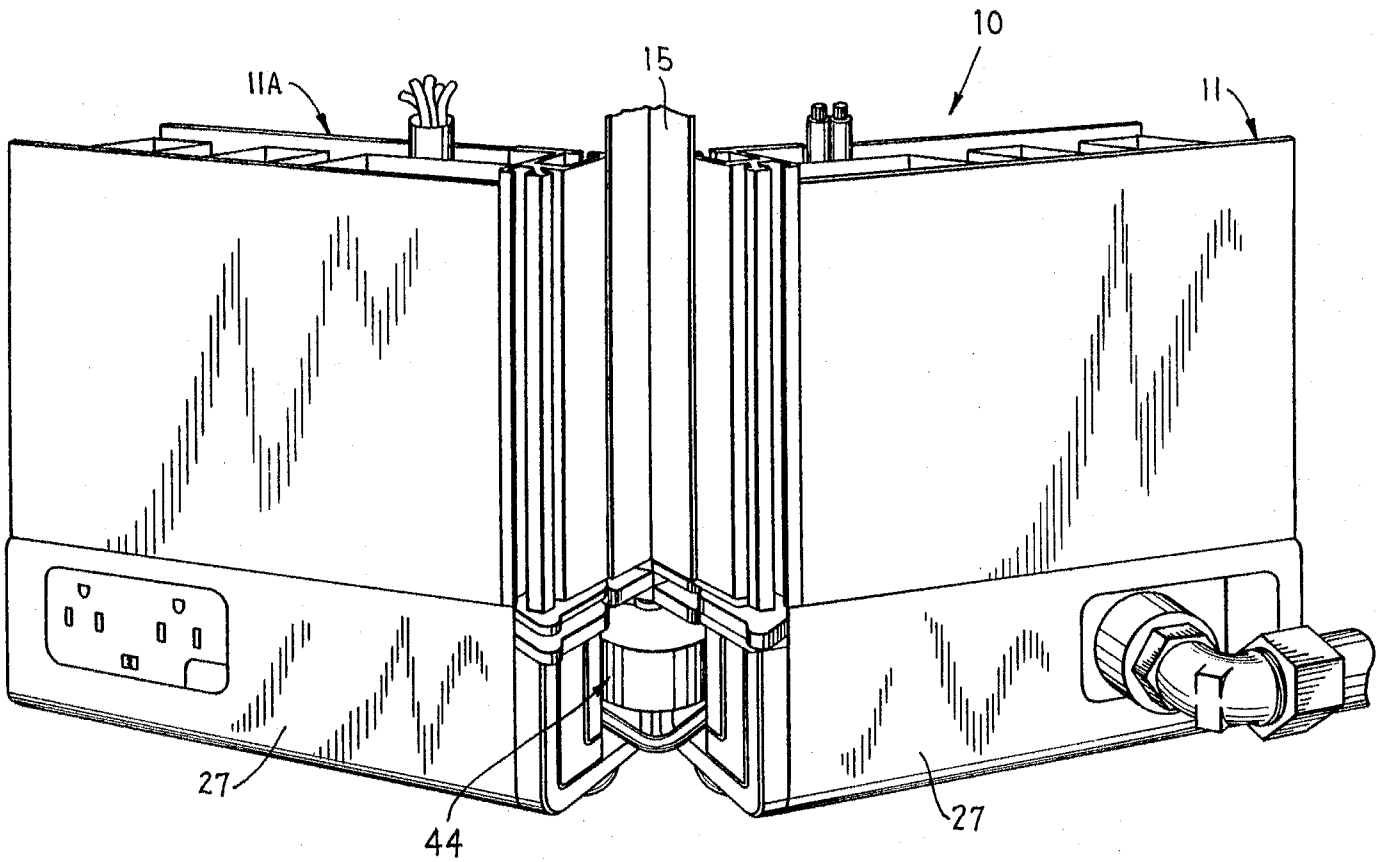
FIG. 8 is a fragmentary perspective view illustrating the adjacent lower corners of two panels which are structurally hingedly joined together, which panels also have the flexible electrical connector joined therebetween.

FIGS. 1 and 8 illustrate a wall system 10 formed by a series of interconnected upright prefabricated wall panels, only two substantially identical panels 11 and 11A being illustrated. Panels of different lengths can be serially interconnected, as by an L-shaped plastic hinge 15.

Figure 1A:
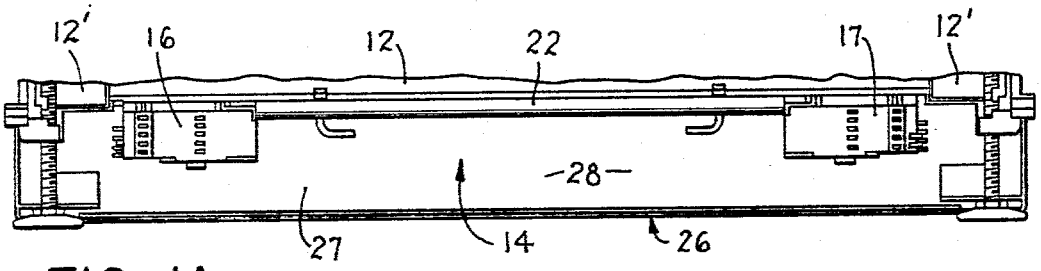
FIG. 1A is an enlarged, fragmentary view illustrating the prewired receway, with cover removed, as associated with the lower edge of the panel.

Each panel, such as panel 11, includes an internal rigid rectangular frame formed by parallel top and bottom rails rigidly joined together by parallel side rails, the bottom rail 12 and side rails 12' being partially illustrated in FIG. 1A. These rails are of channel-shaped configuration and open inwardly of the panel, whereby the frame defines therein a suitable core structure, normally a honeycomb layer of similar conventional structure. The core and frame are normally sandwiched between thin facing sheets disposed at opposite sides of the frame, which sheets in turn are normally covered by a suitable fabric, the latter defining the exterior side faces 13 of the panel. The structure of panel 11 and hinge 15 is well-known, and one such structure is disclosed in U.S. Pat. No. 4,060,294.

Panel 11 (as well as panel 11A) is provided with a prewired electrical system 14 extending longitudinally along the lower edge thereof, which system includes identical power or terminal blocks 16 and 17 disposed adjacent the opposite lower corners of the panel, as illustrated in FIG. 1A. Power blocks 16 and 17 each include a boxlike housing 18 constructed of an electrically insulative material and supporting therein five electrically conductive plates designated 19-1 through 19-5 (FIG. 6), which plates are electrically insulated from one another. The five conductive plates 19 of power blocks 16 and 17 are individually electrically connected by five wire conductors which extend between the power blocks 16 and 17 through an elongated closed channel 22. This latter channel 22 is fixedly but releasably connected to the under side of the bottom frame rail 12.

A raceway 26 is defined along the horizontally extending lower edge of panel 11 so as to enclose the power system 14 therein. The raceway 26 is formed by a pair of substantially identical, elongated L-shaped covers 27 which cooperate with one another and with the bottom rail 12, when mounted on the panel, to define a closed passage 28 which extends longitudinally along the lower panel edge. This passage 28 is isolated from the wire-confining channel 22 to enable communication cables or the like to be fed therethrough.

Each power block 16 and 17 has a pair of identical connector portions 31 associated therewith, which portions face outwardly toward opposite sides of the panel and are identified as 31R and 31L (FIG. 2) for identification purposes. Each said connector portion 31 includes a series of five vertically spaced openings or slots 32 formed in the power block housing, which slots are designated 32-1 through 32-5 and extend completely through the power block so as to comprise a part of both connector portions 31R and 31L. Each connector portion 31 also includes a set of four rigid conductive blades or prongs 33-1 through 33-4 which project outwardly from the power block. The prongs 33 associated with the connector portion 31R are isolated from the prongs associated with the opposite connector portion 31L. Further, the prongs 33-1 through 33-4 are respectively separated from the conductive plates 19-1 through 19-4 by means of the slots 32-1 through 32-4, respectively.

Each power block 16 and 17 also has a further pair of connector portions 34R and 34L associated with the opposite sides thereof, which connector portions are identical and each includes a set of five vertically spaced slots or openings associated with a set of four conductive prongs to permit receptacle units or other types of power tops to be releasably plugged thereto.

The wall system as briefly described above, including the individual panels and the electrical system associated therewith, is illustrated and described in greater detail in co-pending application Ser. No. 44,514, filed June 1, 1979, and the disclosure of this co-pending application is incorporated in its entirety herein by reference.

Figure 3:
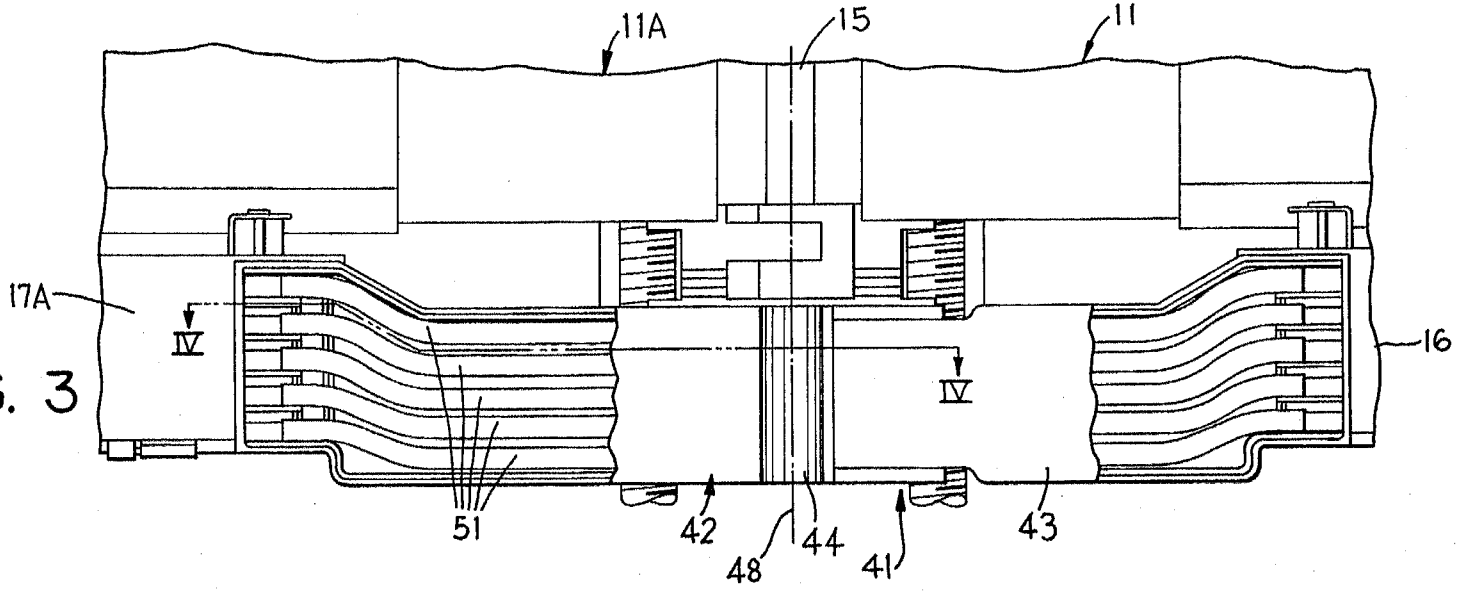
FIG. 3 is a fragmentary elevational view similar to FIG. 2 but with the panel side covers removed, and the housing of the flexible connector partially broken away.
Figure 2:
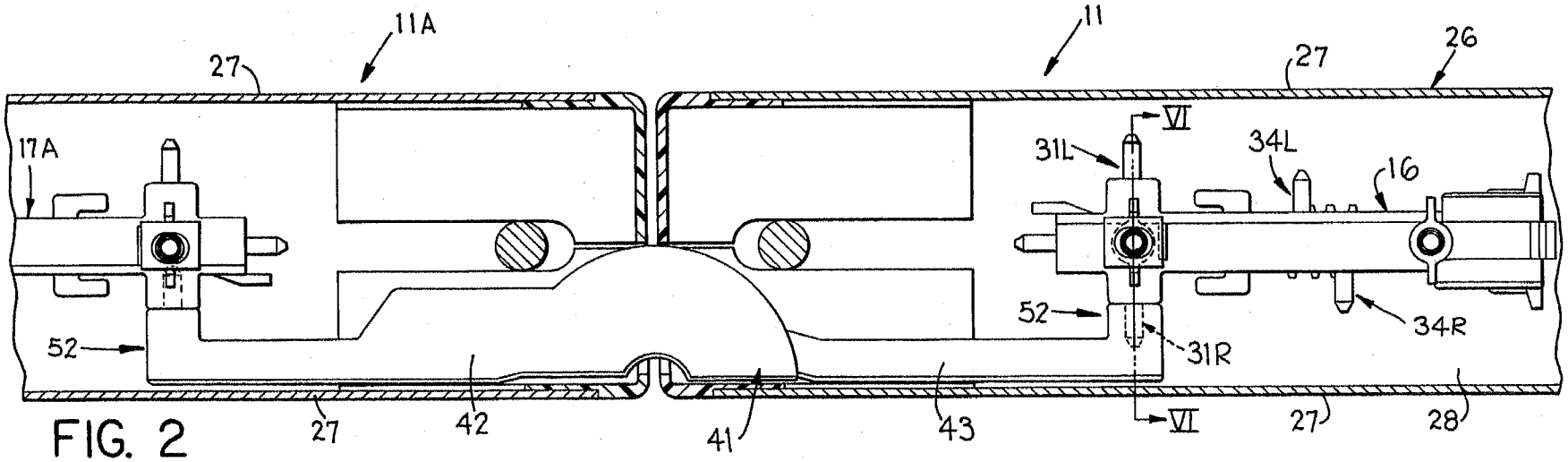
FIG. 2 is an enlarged, fragmentary, partial sectional elevational view showing portions of adjacent panels and the electrical connector joined therebetween.

To electrically interconnected adjacent panels such as 11 and 11A, the adjacent power blocks 16 and 17A are electrically joined by a flexible electrical connector 41 as indicated in FIGS. 2 and 3. This connector 41 includes a pair of rigid housing parts 42 and 43 which are hingedly connected by a hinge structure 44. This hinge structure 44 includes arcuate, i.e. elbow-shaped, interfitting tubular hinge portions 46 and 47 which are integrally formed on the inner ends of the housing parts 42 and 43, respectively, and which angularly slidably telescope one within the other for enabling the two housing parts to be horizontally angularly displaced about an axis 48 which is substantially aligned with the hinge axis defined by the hinge member 15 which structurally joins the adjacent panels together. The housing parts 42 and 43 each effectively comprise a hollow elongated tubular element defining therein a passage 49 through which pass plural, here five, wires 51 which extend through the housing parts for transmitting electrical energy between the identical connector portions 52 as disposed on the outer ends of the housing parts 42 and 43.

Figure 6:
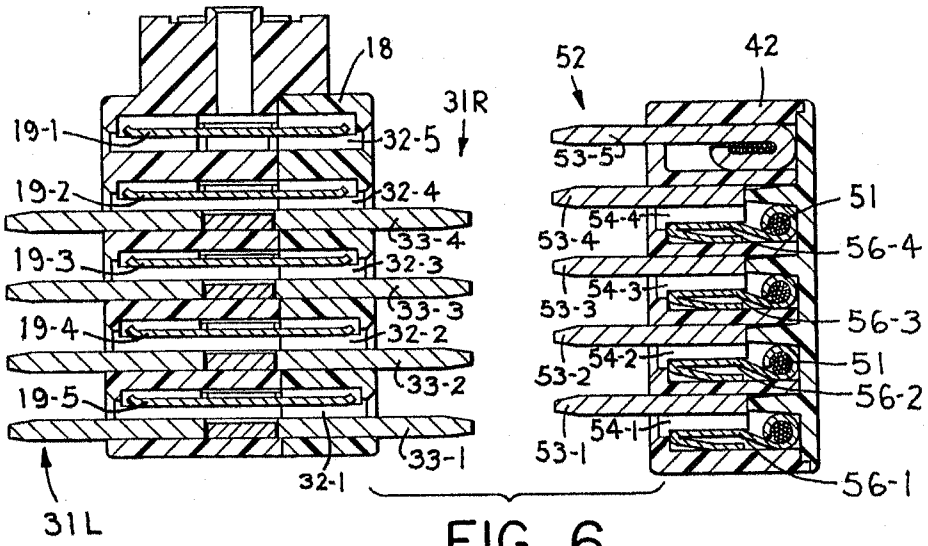
FIG. 6 is an enlarged sectional view of the power block and flexible connector illustrated separated from one another, a part of this view being taken along line VI—VI in FIG. 4.

Each connector portion 52, as illustrated in FIG. 6, includes a set of five electrically conductive prongs 53-1 through 53-5. The uppermost prong 53-5 is directly connected to one of the wires 51 which extends through the flexible connector, namely the ground wire. The remaining four prongs all have a slot or opening 54-1 through 54-4, respectively, associated therewith, which slots respectively separate the prongs 53-1 through 53-4 from the conductive plates 56-1 through 56-4 as provided within the ends of the respective housing parts 42 and 43. These latter conductive plates 56-1 through 56-4 are individually connected directly to the remaining four electrical wires 51 which extend through the flexible connector.

The connector portions 52 are designated for creating a plug-type connection with either of the connector portions 31R or 31L as associated with the power blocks, the relationship between the connector portions 31 and 52 being illustrated in slightly separated relationship in FIG. 6. When the connector portions 31 and 52 are plugged together, the prongs 53 enter into the slots 32 so that the prongs 33 are electrically interconnected to the conductive plates 19, and simultaneously the prongs 33 enter into the slots 54 to electrically join the prongs 53 to the conductive plates 56. This relationship enables the sets of prongs 33 and 53 to be energized only when they are plugged together. Whenever this plugged relationship is separated or disconnected, then all of the prongs 33 and 53 are automatically de-energized.

Considering now the hinge structure 44 associated with the flexible electrical connector 41, the integral hinge portion 46 associated with the housing part 42 includes radially inner and outer walls 61 and 62 which are spaced apart and are each generated about the hinge axis 48, this latter axis being spaced outwardly from the actual hinged structure 44 so as to not intersect same. These radially inner and outer walls 61 and 62 are suitably joined together by top and bottom walls 63 and 64 to effectively define the hollow elbow-shaped tubular structure through which the wires 51 pass. The radially inner and outer arcuate walls 61 and 62 each extend through an angle less than 180°, with these two walls being of substantially the same angular extent. The free edge 65 of the outer arcuate wall 62, however, terminates a substantial distance from the edge of the top and bottom walls so as to define a suitable opening through which passes the other hinge portion 47.

This hinge portion 47 also has radially inner and outer arcuate walls 66 and 67 which are also generated about the hinge axis 48, and are suitably joined together by top and bottom walls 68 and 69. The arcuate walls 66 and 67 are positioned directly adjacent and in fact effectively slide on and between the arcuate walls 61 and 62 to permit the housing parts 42 and 43 to be relatively angularly displaced about the axis 48. The arcuate walls 66 and 67 are of substantially the same angular extent and each extends through an angle less than 180°. In fact, the arcuate walls 61-62 and 66-67 all preferably extend through an angle of at least 90°, and preferably an angle in the neighborhood of 135°.

Figure 4:
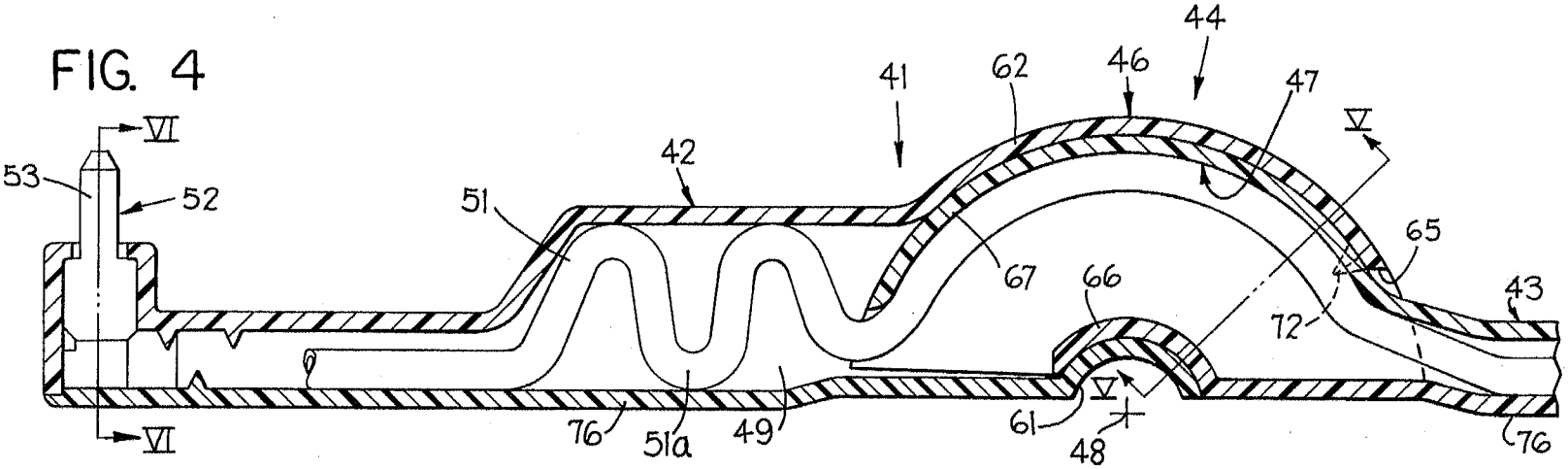
FIG. 4 is a fragmentary enlarged sectional view taken substantially along the line IV—IV in FIG. 3.

To limit the relative angular displacement between the housing parts 42 and 43 to an angle of approximately 105°, which displacement occurs clockwise in FIG. 4 when part 43 is moved, the outer arcuate wall 62 is provided with small integral stops or projections 72 which are located adjacent the upper and lower edges of this arcuate wall adjacent the free edge thereof. These stops are normally accommodated by means of the bevelled corners 71 provided on the inner hinge portion 47, which bevelled corners extend throughout substantially the full arcuate extent of the hinge portion 47 except for the free ends thereof, at which point the bevelled portions terminate so as to result in abutments which abut against the stops 72 to thereby limit the maximum angular displacement between the housing parts.

Figure 5A:
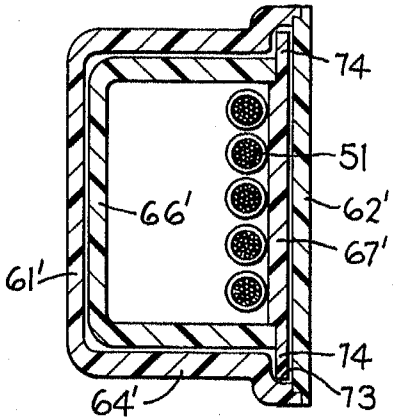
FIG. 5 and 5A are sectional views taken along line V—V in FIG. 4 showing alternative embodiments.
Figure 5:
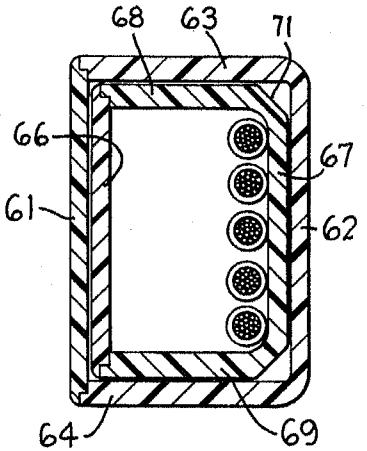

The present invention can also be provided with a guide structure similar to that illustrated in FIG. 5A if desired. In this alternate structure, the outer arcuate wall 62', at its junction with the top and bottom walls, forms narrow arcuate grooves 73 which receive therein riblike projections 74 which project upwardly and downwardly from the opposite edges of the arcuate wall 67' so as to provide for a close slidable and guided confinement of the two hinge portions.

The flexible connector 41, as described above, thus has the hinge structure formed solely by the hinge portions 46 and 47 which are integral with and formed on the inner ends of the housing parts 42 and 43, respectively, whereby these two housing parts thus effectively comprise the sole housing and hinge structure for the flexible connector, whereby the use of hinge pins and the like is unnecessary.

Figure 7:
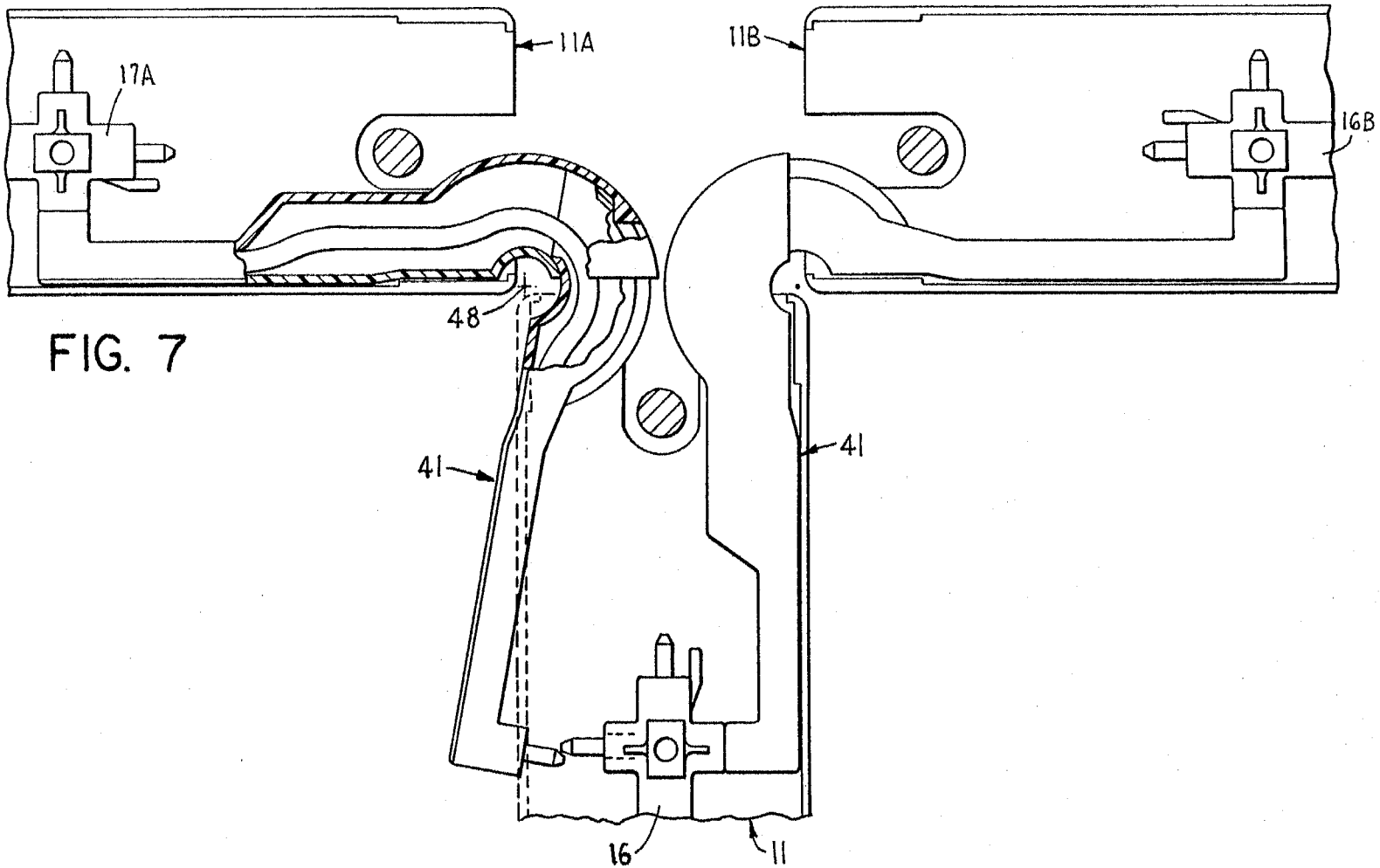
FIG. 7 is a fragmentary partial sectional view illustrating the manner in which three panels are electrically joined together by use of two identical flexible electrical connectors.

FIG. 7 illustrates the manner in which the improved flexible electrical connector 41 of this invention can be used for electrically joining the power block 16 and 17A of two adjacent panels, the two panels being angled in approximately perpendicular relationship to one another, one end of the connector being illustrated in an unplugged relationship. As indicated, the hinge axis 48 lies substantially within the vertical planes defining the outer side surfaces of the panels, and this hinge axis 48 (which is effectively aligned with the hinge axis defined by the structural hinge 15) is spaced from the actual physical hinge structure 44.

FIG. 7 also illustrates the manner in which a further identical connector 41 can be used for joining the panel 11 to still a third panel 11B so that three panels can be located at a common junction or intersection and be simultaneously electrically interconnected through use of two identical connectors 41. When so connected, the connectors are disposed substantially wholly within the interior of the panels inasmuch as the hinge structure does not project outwardly beyond the side surfaces of the panels. Further the hinge structure also does not project inwardly beyond the central vertical plane, whereby two such connectors 41 can thus be disposed in substantially side-by-side relationship without interfering with one another, as illustrated by FIG. 7.

The wires 51 are normally positioned in close proximity to the outer arcuate wall 67 when the connector is in a straight condition substantially as illustrated in FIG. 3, in which condition the wires 51 are normally provided with preformed curved portions **51*a* as accommodated within the slight enlargement formed within the housing part 42. When the flexible connector is angularly displaced, such as into the position illustrated by FIG. 7, this thus causes the wires 51 to be drawn radially inwardly toward the inner arcuate wall 66, thus causing straightening out of the preformed curved portions 51*a*. However, when the connector is again straightened out, then the curved portions 51*a*** will automatically return to approximately their preformed shape.

As illustrated in FIG. 4, the hinge axis 48 is disposed substantially within a vertical plane defined by the front surfaces 76 of the housing parts 42 and 43, the axis 48 being extremely close to but normally spaced slightly forward from this latter plane. In contrast, the prongs 53 defining the connector portions 52 project from the rear side of the housing parts 42 and 43 in substantially perpendicular relationship to the vertical plane defined by the surface 76.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a space-dividing wall structure formed from a plurality of prefabricated upright panels which are serially connected together, said wall structure including a prewired electrical system associated therewith and extending longitudinally therealong, said electrical system including a pair of power blocks mounted on each panel adjacent the opposite vertical edges thereof and electrical cable means extending interiorly of each panel and connected between said pair of power blocks for defining an electrical circuit, said electrical system also including a hinged electrical connector releasably connected between the opposed power blocks of adjacent panels for electrically connecting the adjacent panels together so that the electrical circuit extends longitudinally throughout the plurality of serially-connected panels, said hinged electrical connector including a pair of rigid housing parts having integral hinge portions formed on the inner ends thereof and hingedly connected together for permitting relative swinging between said housing parts about a substantially vertically-extending hinge axis, each said housing part also having an electrical connector portion associated with the outer end thereof for releasable connection to a respective one of said power blocks, the improvement wherein the integral hinge portion as associated with each housing part comprises a tubular portion which is open at one end with said hinge portions being slidably and telescopically fitted one within the other, each said hinge portion including a pair of spaced and substantially parallel sidewalls each of which is generated on a radius about the hinge axis, with one of the sidewalls being generated on a radius substantially greater than the radius used to generate the other sidewall, whereby the hinge portions when slidably telescoped together permit relative angular displacement between the housing parts about said hinge axis.

2. A wall structure according to claim 1, wherein the hinge portions define a hinge structure formed solely by said integral hinge portions, and said hinge structure being positioned wholly between pairs of vertical planes as defined by the exterior side surfaces of the connected adjacent panels when said hinged electrical connector is joined to the opposed power blocks of said adjacent panels.

3. A wall structure according to claim 2, wherein said hinge axis is spaced outwardly from and does not pass through or intersect the physical structure of said integral hinge portions as defined by said telescoped tubular portions.

4. A wall structure according to claim 1, wherein said hinge axis is spaced outwardly from and does not pass through or intersect the physical structure of said integral hinge portions as defined by said telescoped tubular portions.

5. A wall structure according to claim 1, wherein the tubular portion defining each said hinge portion is defined by substantially planar and horizontal top and bottom walls disposed in substantially parallel relationship and joined together by the respective pair of sidewalls which are both arcuate and of different radius as generated about said hinge axis, said hinge axis being spaced sidewardly from said tubular structure so as to not intersect same, the tubular structure defining each said hinge portion resembling an elbow and extending through an angle of between 90° and 180°.

6. A wall structure according to claim 1, wherein each said housing part comprises an elongated tubular member having the hinge portion integrally formed on the inner end thereof, each said tubular member including a substantially planar and vertical sidewall which is disposed substantially flush with or spaced slightly inwardly from the vertical plane defining the side surfaces of the respective panel, said hinge axis extending vertically substantially within or spaced slightly outwardly from said plane, and said hinge portions each having the configuration of an arcuate elbow extending through an angle of no more than 180° and extending inwardly from said plane.

7. A wall structure according to claim 1, wherein each of said housing parts comprises an elongated tubular member having a substantially planar front sidewall, a plurality of electrically conductive prongs mounted on each said housing part adjacent the outer end thereof, said prongs projecting rearwardly from the respective housing part in substantially perpendicular relationship to the front sidewall, the hinge portion associated with each housing part being integral with the inner end of the housing part and formed as an arcuate hollow elbow which is open at the free end thereof and is in open communication with the interior of the housing part, said elbow in its entirety projecting inwardly from the front sidewall, said elbow being generated about said hinge axis, with said latter axis being disposed substantially within or spaced forwardly from the vertical plane defined by said front sidewall, said axis being spaced forwardly from the hinge portions so as to not intersect the structure thereof.

8. A hinged electrical connector for creating a releasable plug-like electrical connection with a pair of power blocks as provided on a pair of adjacent wall panels, said electrical connector comprising:

first and second rigid housing parts formed as an elongated tubular member, a hinge structure cooperating between the adjacent inner ends of said housing parts for permitting relative swinging movement therebetween about a hinge axis which extends perpendicular to the elongated direction of said housing parts, said hinge structure comprising an elbow-shaped tubular portion integrally formed on the inner end of each housing part, the two elbow-shaped tubular portions being slidably guidably telescoped one within the other for permitting relative swinging movement between said housing parts about said hinge axis, said elbow-shaped tubular portions as associated with said two housing parts defining the sole hinge structure, each elbow-shaped tubular portion being open at the free end thereof and being defined by spaced top and bottom walls which are integrally joined together by spaced front and rear sidewalls, the front and rear sidewalls each being arcuate and generated on a radius defined about said hinge axis, said latter axis being spaced outwardly from said front sidewall so that the radius which generates said front sidewall is substantially smaller than the radius which generates said rear sidewall, a plurality of electrically conductive prongs mounted on each said housing part adjacent the outer end thereof, and a plurality of electrically conductive wires extending through the interior of said hinge structure, the opposite ends of said wires being associated for electrical interconnection with the prongs associated with the free ends of said housing parts.

9. A connector according to claim 8, wherein the housing parts have substantially planar front sidewalls, said prongs projecting rearwardly of said connector in substantially perpendicular relationship to said front sidewalls, said elbow-shaped tubular portions also projecting rearwardly in their entirety from the plane defined by said front sidewalls, and said hinge axis being located closely adjacent or slightly outwardly from said last-mentioned plane, said hinge axis being spaced from and not intersecting any of the physical structure of said connector.

10. A connector according to claim 8, wherein said elbow-shaped tubular portions each extend through an angle of between 90° and 180° as measured about said hinge axis, and said hinge axis being spaced from and not intersecting any of the structure of said connector.

* * * * *